US011002126B2

(12) United States Patent
Wang et al.

(10) Patent No.: US 11,002,126 B2
(45) Date of Patent: May 11, 2021

(54) ACTIVE CONTROL METHOD AND CONTROL DEVICE FOR WELLBORE PRESSURE IN THE OPEN-CYCLE DRILLING OF MARINE NATURAL GAS HYDRATES

(71) Applicant: CHINA UNIVERSITY OF PETROLEUM (EAST CHINA), Qingdao (CN)

(72) Inventors: Zhiyuan Wang, Qingdao (CN); Jianbo Zhang, Qingdao (CN); Baojiang Sun, Qingdao (CN); Wenqiang Lou, Qingdao (CN); Xiaohui Sun, Qingdao (CN); Zheng Liu, Qingdao (CN); Shikun Tong, Qingdao (CN)

(73) Assignee: CHINA UNIVERSITY OF PETROLEUM (EAST CHINA), Qingdao (CN)

( * ) Notice: Subject to any disclaimer, the term of this patent is extended or adjusted under 35 U.S.C. 154(b) by 0 days.

(21) Appl. No.: 17/110,354

(22) Filed: Dec. 3, 2020

(65) Prior Publication Data

US 2021/0087918 A1 Mar. 25, 2021

(51) Int. Cl.

| | |
|---|---|
| ***E21B 44/06*** | (2006.01) |
| ***E21B 41/00*** | (2006.01) |
| ***E21B 47/008*** | (2012.01) |
| ***E21B 47/07*** | (2012.01) |
| ***E21B 47/08*** | (2012.01) |
| ***E21B 47/047*** | (2012.01) |

(52) U.S. Cl.

CPC ..... *E21B 44/06* (2013.01); *E21B 41/0099* (2020.05); *E21B 47/008* (2020.05); *E21B 47/047* (2020.05); *E21B 47/07* (2020.05); *E21B 47/08* (2013.01); *E21B 2200/20* (2020.05)

(58) Field of Classification Search

CPC ..... E21B 44/06; E21B 47/047; E21B 47/08; E21B 47/07; E21B 47/008; E21B 41/0099; E21B 2200/20

See application file for complete search history.

(56) References Cited

U.S. PATENT DOCUMENTS 4,422,513 A * 12/1983 Franklin ..... E21B 21/067 175/17

2017/0175468 A1* 6/2017 Vail, III ..... E21B 21/12

* cited by examiner

*Primary Examiner* — Taras P Bemko
*Assistant Examiner* — Yanick A Akaragwe
(74) *Attorney, Agent, or Firm* — CBM Patent Consulting, LLC

(57) ABSTRACT

An active control method and system for wellbore pressure in open-cycle drilling in marine natural gas hydrates. The system comprises a drilling system, a drilling fluid injection system, and a data processing system for conducting the drilling operation.

10 Claims, 1 Drawing Sheet

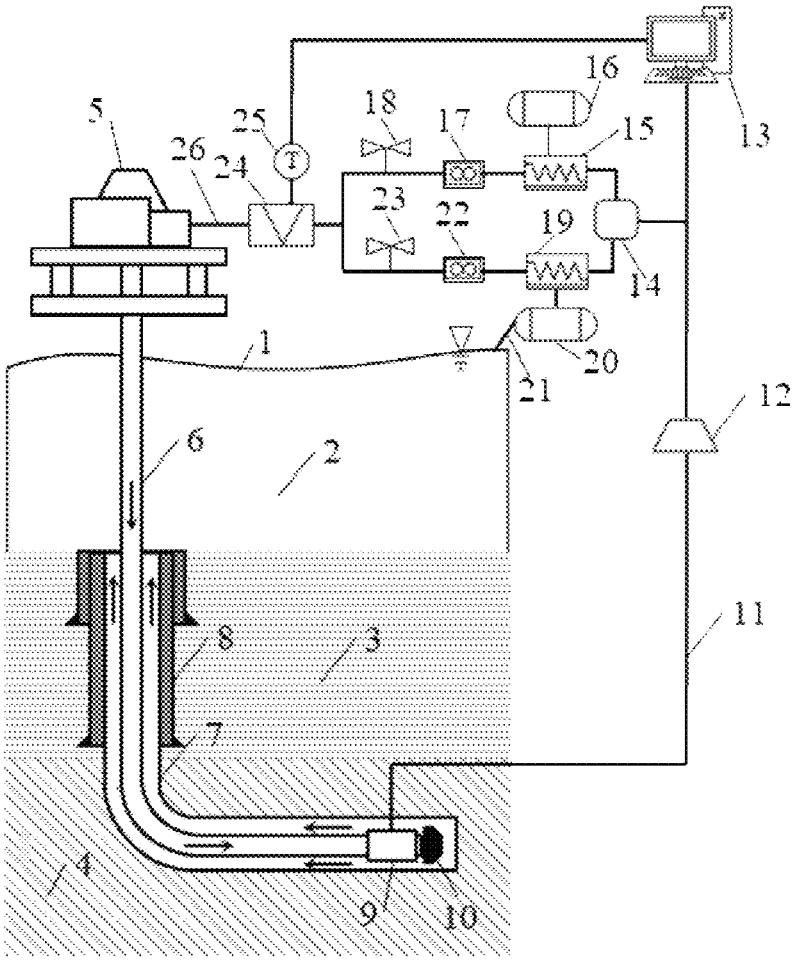
5
26
24
25
18
17
16
15
13
23
22
19
14
1
20
21
12
6
2
11
8
3
7
4
9
10

ACTIVE CONTROL METHOD AND CONTROL DEVICE FOR WELLBORE PRESSURE IN THE OPEN-CYCLE DRILLING OF MARINE NATURAL GAS HYDRATES

This application claims priority to Chinese Patent Application Ser. No. CN202010774242.1 filed on 4 Aug. 2020.

TECHNICAL FIELD

The invention is related to an active control method and control device for wellbore pressure in the open-cycle drilling of marine natural gas hydrates and belongs to the technical field of marine natural gas hydrate drilling.

BACKGROUND ART

As an efficient and clean potential alternative energy source, the natural gas hydrate (NGH), which is mainly distributed in the low-temperature and high-pressure sediments of the submarine continental slopes and permafrost, will be the commanding point of strategy of global energy development in the future. Marine NGH, as a part of the NGH, enjoys promising prospects relying on its huge reserves that account for about 99% of the total NGH resources. However, its shallow burial, poor lithology, low formation strength, and existence of shallow gas have brought many difficulties in drilling engineering.

To increase the mining output, the mining well type used by the marine NGH begins to switch from the original vertical wells to horizontal wells. However, compared to a vertical well, a horizontal well has a larger difficulty in safety control while drilling mainly because of its long horizontal section, high friction, and very tough pressure control. The easy decomposition of the NGH from the peeling cuttings in the bottom hole and the common occurrence of well leakage, well kick, and collapse have exerted great challenges to safe and efficient drilling of such a well type. Currently, the unavailability of a specific safe and efficient drilling method for the marine NGH has become a technical difficulty restricting the efficient development of the marine NGH.

Therefore, it is of great significance for the safe and efficient drilling of the marine NGH to develop as fast as possible a specific safe and efficient drilling method that can proactively control the wellbore pressure within a safe range before the well kick, well leakage and other phenomena become prominent. The invention is born just for this.

DESCRIPTION OF THE INVENTION

In view of the shortcomings of the existing technologies, particularly the existing technical problems in the marine NGH drilling, including high drilling costs and difficult safety control, the invention has presented an active control method and control device for wellbore pressure in the open-cycle drilling of marine natural gas hydrates. The control method proposed in the invention can realize real-time monitoring and intelligent active control of safety risks in the drilling process based on the offshore drilling theory and in combination with the NGH drilling characteristics, thus guaranteeing the safe and efficient drilling of the marine NGH.

Term Interpretation

Wellbore annulus temperature: it refers to the temperature of the drilling fluid in the wellbore annulus.

APWD (Annular Pressure While Drilling): it refers to a measuring tool of annular pressure while drilling.

The technical solution of the invention is as follows:

An active control method for wellbore pressure in the open-cycle drilling of marine natural gas hydrates, which comprises steps as follows:

(1) Optimized design of drilling parameters: design the drilling fluid displacement, pump pressure in wellhead, and injection temperature of drilling fluid for the drilling through calculations based on the data of the marine NGH reservoirs to be drilled;

(2) Open-cycle drilling: carry out open-cycle drilling according to the drilling parameters designed in step (1) by injecting seawater into the drill pipe as drilling fluid to carry the cuttings from the bottom hole and discharge them out of the subsea wellhead through the annulus between the drill pipe and the casing pipe;

(3) Real-time monitoring of drilling: utilize the APWD to monitor the bottom-hole temperature and the bottom-hole pressure in real time for real-time correction of the wellbore annulus temperature and wellbore annulus pressure calculation models; determine whether a hydrate decomposition has occurred in the annulus and then infer whether a shallow gas intrusion has occurred in the bottom hole to lay a foundation for the intelligent active control of the wellbore pressure in the later stage;

(4) Intelligent active control: control and adjust the mixed density of drilling fluid, the injection displacement of drilling fluid as well as the injection temperature of drilling fluid and the pump pressure in wellhead automatically during the well killing in the case of hydrate decomposition in the annulus or shallow gas intrusion in the bottom hole based on the real-time treatment results of the computer terminal for the signal fluctuations detected by the APWD; inject drilling fluid into the bottom hole via the drill pipe based on the above well-killing parameters; if no hydrate decomposition occurs in the annulus and no shallow gas invasion occurs in the bottom hole, continue with the drilling according to the drilling parameters set in step (1) until drilling is completed;

According to an embodiment of the invention, a reasonable design of the drilling fluid displacement, pump pressure in wellhead, injection temperature of drilling fluid, and other drilling parameters in step (1) can keep the bottom-hole temperature and pressure within a safe range to avoid well kick, well leakage, hydrate decomposition, and other downhole problems.

According to a preferred embodiment of the invention, to meet the requirements of rock breaking, cutting carrying, gas-cut prevention, and well leakage prevention, etc., the drilling fluid displacement during the drilling in step (1) satisfies the following relational formula:

$$Q_{min}<Q<Q_{max} \tag{1}$$

Where: $Q_{min}$ denotes the theoretical minimum displacement, $m^3$/min; $Q_{max}$ denotes the theoretical maximum displacement, $m^3$/min; and Q denotes the drilling fluid displacement during the drilling.

The theoretical minimum displacement $Q_{min}$ is mainly affected by rock breaking, cutting carrying and gas-cut prevention, etc., and it satisfies the following relational formula:

$$Q_{min}=\max(Q_p, Q_x, Q_q) \tag{2}$$

Where: $Q_p$ denotes the minimum rock-breaking displacement, $m^3$/min; $Q_x$ denotes the minimum cutting-carrying displacement, $m^3$/min; and $Q_q$ denotes the minimum displacement used to prevent shallow gas intrusion, $m^3$/min;

Among them, the minimum rock-breaking displacement $Q_p$ satisfies the following relational formula:

$$Q_p = k_f \pi d_{ne}^2 \left( \frac{S_u k^2 x^2}{16 \lambda \rho_m R_0^2} \right)^{0.5} \tag{3}$$

Where: $k_f$ denotes the bit nozzle flow coefficient, which shall fall within 0.95-0.97; $d_{ne}$ denotes the equivalent diameter of the bit nozzle, m; $S_u$ denotes the shearing strength of soil, Pa; k denotes the half-width coefficient of jet flow; x denotes the impact flow path of jet flow, m; λ denotes the pressure drop coefficient of jet flow; $\rho_m$ denotes the density of the drilling fluid in the drill pipe, kg/m$^3$; and $R_0$ denotes the bit nozzle radius, m;

The minimum cutting-carrying displacement $Q_x$ satisfies the following relational formula:

$$Q_x = \frac{\pi}{4000}(d_w^2 - d_{po}^2) v_a \tag{4}$$

Where: $d_w$ denotes the inner diameter of the borehole, m; $d_{po}$ denotes the outer diameter of the drill pipe, m; and $v_a$ denotes the flow velocity of the drilling fluid in the annulus, m/s.

The minimum displacement required for prevention of shallow gas intrusion $Q_q$ satisfies the following relational formula:

$$Q_q = 0.592 d^{2.5} \left( \frac{P_r - P_{wh} - \rho_{sw} g h}{f \rho_{sw} L} \right) \tag{5}$$

Where: d denotes the cross section diameter, m; $P_r$ denotes the hydrate reservoir pressure, Pa; $P_{wh}$ denotes the hydrostatic pressure of the seawater, Pa; $\rho_{sw}$ denotes the seawater density, kg/m$^3$; g denotes the gravitational acceleration, m/s$^2$; h denotes the depth from the mud line to the bottom hole, m; f denotes the friction resistance coefficient of the annulus, which is zero-dimension; and L denotes the flow path of the drilling fluid, m.

The theoretical maximum displacement $Q_{max}$ is mainly affected by the equipment capacity and the formation security window, and it satisfies the following relational formula:

$$Q_{max} = \min(Q_s, Q_m) \tag{6}$$

Where: $Q_s$ denotes the maximum permissible displacement of the drilling equipment, m$^3$/min; and $Q_m$ denotes the maximum displacement allowed in the security window of the hydrate reservoir, m$^3$/min;

Among them, the maximum displacement allowed in the security window of the hydrate reservoir $Q_m$ is calculated as follows:

$$Q_m = 0.592 d^{2.5} \left( \frac{P_c - P_{wh} - \rho_{sw} g h}{f \rho_{sw} L} \right) \tag{7}$$

Where: $P_c$ denotes the minimum value of the bottom hole fracture pressure and the bottom hole leakage pressure, Pa; d denotes the cross section diameter, m; $P_{wh}$ denotes the hydrostatic pressure of seawater, Pa; $\rho_{sw}$ denotes the seawater density, kg/m$^3$; g denotes the gravitational acceleration, m/s$^2$; h denotes the depth from the mud line to the bottom hole, m; f denotes the friction resistance coefficient of the annulus, which is zero-dimension; and L denotes the flow path of the drilling fluid, m;

Among them, $P_c$ satisfies the following relational formula:

$$P_c = \min(P_p, P_L) \tag{8}$$

Where: $P_p$ denotes the bottom hole fracture pressure, Pa; and $P_L$ denotes the bottom hole leakage pressure, Pa.

According to a preferred embodiment of the invention, the pump pressure in wellhead during the drilling in step (1) is the sum of the bit pressure drop, the drill pipe pressure loss, and the annulus pressure loss, as shown in the following formula:

$$P_b = \Delta P_z + \Delta P_p + \Delta P_a \tag{9}$$

Where: $P_b$ denotes the pump pressure in wellhead during the drilling, Pa; $\Delta P_z$ denotes the bit pressure drop, Pa; $\Delta P_p$ denotes the drill pipe pressure loss, Pa; and $\Delta P_a$ denotes the annulus pressure loss, Pa.

According to a preferred embodiment of the invention, the injection temperature of drilling fluid during the drilling in step (1) refers to the temperature of the drilling fluid at the inlet of the drill pipe, and the temperature of the drilling fluid in the drill pipe can be calculated by the following relational formula:

$$A_p \rho_m v_p c_m \frac{\partial T_p}{\partial s} + m_p c_m \frac{\partial T_p}{\partial t} - 2\pi r_p \frac{U_p}{A_a}(T_a - T_p) = 0 \tag{10}$$

Where: $A_p$ denotes the cross sectional area inside the drill pipe, m$^2$; $\rho_m$ denotes the density of the drilling fluid in the drill pipe, kg/m$^3$; $v_p$ denotes the flow velocity of the drilling fluid in the drill pipe, m/s; $c_m$ denotes the specific heat capacity of the drilling fluid in the drill pipe, J/(kg·K); s denotes the distance from any point in the flow direction to the bottom hole, m; $m_p$ denotes the mass flow rate of the drilling fluid in the drill pipe, kg/s; t denotes time, s; $r_p$ denotes drill pipe radius, m; $U_p$ denotes the total heat transfer coefficient in the drill pipe, W/(m$_2$·K); $A_a$ denotes the cross sectional area of the annulus, m$^2$; $T_a$ denotes the wellbore annulus temperature, K; and $T_p$ denotes the temperature of the drilling fluid in the drill pipe, K;

Among them, the wellbore annulus temperature $T_a$ during the drilling satisfies the following relational formula:

$$A_p \rho_m v_a c_m \frac{\partial T_a}{\partial s} - m_a c_m \frac{\partial T_a}{\partial t} - 2\pi r_a \frac{U_a}{A_a}(T_{en} - T_a) + 2\pi r_p \frac{U_p}{A_a}(T_a - T_p) = 0 \tag{11}$$

Where: $A_p$ denotes the cross sectional area inside the drill pipe, m$^2$; $\rho_m$ denotes the density of the drilling fluid in the drill pipe, kg/m$^3$; $v_a$ denotes the flow velocity of the drilling fluid in the annulus, m/s; $c_m$ denotes the specific heat capacity of the drilling fluid in the drill pipe, J/(kg·K); $T_a$ denotes the wellbore annulus temperature, K; s denotes the distance from any point in the flow direction to the bottom hole, m; $m_a$ denotes the mass flow rate of the drilling fluid in the annulus, kg/s; t denotes time, s; $r_a$ denotes the annulus radius, m; $U_a$ denotes the total heat transfer coefficient in the annulus, W/(m$_2$·K); $A_a$ denotes the cross sectional area of the annulus, m$_2$; $T_{en}$ denotes the temperature of the hydrate formation, K; $r_p$ denotes the drill pipe radius, m; $U_p$ denotes the total heat transfer coefficient in the drill pipe, W/($m_2$·K); and $T_p$ denotes the temperature of the drilling fluid in the drill pipe, K.

To prevent the NGH in the peeling cuttings from decomposing in the annulus during the drilling, the wellbore annulus temperature $T_a$ needs to satisfy the following condition:

$$T_a < T_e \tag{12}$$

Where: $T_a$ denotes the wellbore annulus temperature, K; and $T_e$ denotes the equilibrium temperature of the NGH, K.

Among them, the equilibrium temperature of the NGH $T_e$ satisfies the following relational formula:

$$T_e = \frac{9459}{49.3185 - \ln\left(\frac{P_a}{1.15}\right)} \tag{13}$$

Where: $P_a$ denotes the annulus pressure at a given well depth, Pa.

The wellbore annulus pressure at a given well depth $P_a$ during the drilling can be calculated as follows:

$$\frac{\partial P_a}{\partial s} = -\rho_{ca} v_a \frac{\partial v_a}{\partial s} - \rho_{ca} g \cos\theta - \frac{2 f \rho_{ca} v_a^2}{D} \tag{14}$$

Where: s denotes the distance from any point in the flow direction to the bottom hole, m; $\rho_{ca}$ denotes the density of the drilling fluid in the annulus, kg/m$^3$; $v_a$ denotes the flow velocity of the drilling fluid in the annulus, m/s; g denotes the gravitational acceleration, m/s$^2$; θ denotes the hole drift angle, °; f denotes the friction resistance coefficient of the annulus, which is zero-dimension; and D denotes the equivalent diameter of the annulus, m.

According to an embodiment of the invention, the open-cycle drilling method in step (2) has advantages as follows: it has lower requirements for the rig as it needs no drilling riser that tends to be thousands of meters long; it can complete drilling operations by selecting merely a platform with small variable load; and it can improve the drilling efficiency and thereby reduce the drilling costs.

According to a preferred embodiment of the invention, the calculation model of the wellbore annulus temperature $T_a$ during the drilling in step (3) is as shown in the following formula:

$$A_p \rho_m v_a c_m \frac{\partial T_a}{\partial s} - m_a c_m \frac{\partial T_a}{\partial t} - 2\pi r_a \frac{U_a}{A_a}(T_{en} - T_a) + 2\pi r_p \frac{U_p}{A_a}(T_a - T_p) = 0 \tag{15}$$

Where: $A_p$ denotes the cross sectional area inside the drill pipe, m$^2$; $\rho_m$ denotes the density of the drilling fluid in the drill pipe, kg/m$^3$; $v_a$ denotes the flow velocity of the drilling fluid in the annulus, m/s; $c_m$ denotes the specific heat capacity of the drilling fluid in the drill pipe, J/(kg·K); $T_a$ denotes the wellbore annulus temperature, K; s denotes the distance from any point in the flow direction to the bottom hole, m; $m_a$ denotes the mass flow rate of the drilling fluid in the annulus, kg/s; t denotes time, s; $r_a$ denotes the annulus radius, m; $U_a$ denotes the total heat transfer coefficient in the annulus, W/($m_2$·K); $A_a$ denotes the cross sectional area of the annulus, $m_2$; $T_{en}$ denotes the temperature of the hydrate formation, K; $r_p$ denotes the drill pipe radius, m; $U_p$ denotes the total heat transfer coefficient in the drill pipe, W/($m_2$·K); and $T_p$ denotes the temperature of the drilling fluid in the drill pipe, K.

The calibration procedures of the temperature model are as follows: calibrate the total heat transfer coefficient in the annulus ($U_a$) and the total heat transfer coefficient in the drill pipe ($U_p$) in the formula (15) by comparing the theoretical wellbore annulus temperature calculated by the formula (15) and the bottom hole temperature $T_{bh}$ measured by the APWD to make the wellbore annulus temperature $T_a$ calculated theoretically consistent with the bottom hole temperature $T_{bh}$ measured by the APWD, so that the temperature field distribution calculated by the temperature model of the wellbore annulus temperature $T_a$ can be more accurate; then, determine whether the hydrate in the wellbore annulus has decomposed by comparing the wellbore annulus temperature $T_a$ and the equilibrium temperature of the NGH $T_e$.

According to a preferred embodiment of the invention, the calculation model of the wellbore annulus pressure at a certain well depth $P_a$ in step (3) during the drilling is as shown in the following formula:

$$\frac{\partial P_a}{\partial s} = -\rho_{ca} v_a \frac{\partial v_a}{\partial s} - \rho_{ca} g \cos\theta - \frac{2 f \rho_{ca} v_a^2}{D} \tag{16}$$

Where: s denotes the distance from any point in the flow direction to the bottom hole, m; $\rho_{ca}$ denotes the density of the drilling fluid in the annulus, kg/m$^3$; $v_a$ denotes the flow velocity of the drilling fluid in the annulus, m/s; g denotes the gravitational acceleration, m/s$^2$; θ denotes the hole drift angle, °; f denotes the friction resistance coefficient of the annulus, which is zero-dimension; and D denotes the equivalent diameter of the annulus, m.

The calibration procedures of the pressure model are as follows: calibrate the friction resistance coefficient of the annulus f in the formula (16) by comparing the bottom hole pressure $P_a$ theoretically calculated by the formula (16) and the bottom hole pressure $P_{bh}$ measured by the APWD to make the bottom hole temperature $P_a$ calculated theoretically consistent with the bottom hole pressure $P_{bh}$ measured by the APWD, so that the pressure distribution calculated by the pressure model of the wellbore annulus can be more accurate According to a preferred embodiment of the invention, the judgment condition of whether hydrate decomposition has occurred in the bottom hole in step (3) is:

$$T_{bh} < \frac{9459}{49.3185 - \ln\left(\frac{P_{bh}}{1.15}\right)} \tag{17}$$

Where: $T_{bh}$ denotes the bottom hole temperature measured by the APWD, K; and $P_{bh}$ denotes the bottom hole pressure measured by the APWD, Pa.

According to a preferred embodiment of the invention, the judgment condition of whether shallow gas has intruded into the wellbore in the bottom hole in step (3) is the bottom hole temperature measured by the APWD has increased by no less than 0.1° C. and the bottom hole pressure has decreased by no less than 0.1 MPa. This is mainly because the shallow gas will increase the temperature and reduce the pressure of the fluid in the wellbore after intrusion due to its high temperature and low density.

According to a preferred embodiment of the invention, the mixed density of the drilling fluid during the well killing in step (4) satisfies the following relational formula:

$$\frac{P_r - \rho_{sw} g h_{sw}}{gh} \le \rho_1 \le \frac{P_p - \rho_{sw} g h_{sw}}{gh} \tag{18}$$

Where: $P_r$ denotes the hydrate reservoir pressure, Pa; $\rho_{sw}$ denotes the seawater density, kg/m$^3$; g denotes the gravitational acceleration, m/s$^2$; $h_{sw}$ denotes the water depth at the seabed mud line, m; h denotes the depth from the mud line to the bottom hole, m; $\rho_1$ denotes the mixed density of the drilling fluid during the well killing, kg/m$^3$; and $P_p$ denotes the bottom hole fracture pressure, Pa.

According to a preferred embodiment of the invention, the drilling fluid displacement during the well killing in step (4) is calculated as follows:

$$0.592d^{2.5}\left(\frac{P_r - P_{wh} - \rho_1 gh}{f\rho_1 L}\right) < Q_y < \min\left(Q_s,\ 0.592d^{2.5}\left(\frac{P_c - P_{wh} - \rho_1 gh}{f\rho_1 L}\right)\right) \tag{19}$$

Where: d denotes the cross section diameter, m; $P_r$ denotes the hydrate reservoir pressure, Pa; $P_{wh}$ denotes the hydrostatic pressure of seawater, Pa; $\rho_1$ denotes the mixed density of the drilling fluid during the well killing, kg/m$^3$; g denotes the gravitational acceleration, m/s$^2$; h denotes the depth from the mud line to the bottom hole, m; f denotes the friction resistance coefficient of the annulus, which is zero-dimension; L denotes the flow path of the drilling fluid, m; $Q_y$ denotes the drilling fluid displacement during the well killing, m$^3$/min; $Q_s$ denotes the maximum permissible displacement of the drilling equipment, m$^3$/min; $P_c$ denotes the minimum value of the bottom-hole fracture pressure and the leakage pressure, Pa.

According to a preferred embodiment of the invention, the pump pressure in wellhead during the well killing in step (4) is the sum of the pressure difference between the inside and outside hydrostatic columns of the drill pipe and the cycling friction resistance of each section, and it satisfies the following relational formula:

$$P_{b2} = \Delta P_z + \Delta P_p + \Delta P_a + (\rho_{sw} - \rho_1) g h_{sw} \times 10^{-6} \tag{20}$$

Where: $P_{b2}$ denotes the pump pressure in wellhead during the well killing, Pa; $\Delta P_z$ denotes the bit pressure drop, Pa; $\Delta P_p$ denotes the drill pipe pressure loss, Pa; $\Delta P_a$ denotes the annulus pressure loss, Pa; $\rho_{sw}$ denotes the seawater density, kg/m$^3$; $\rho_1$ denotes the mixed density of the drilling fluid during the well killing, kg/m$^3$; g denotes the gravitational acceleration, m/s$^2$; and $h_{sw}$ denotes the water depth at the seabed mud line, m.

According to a preferred embodiment of the invention, the injection temperature of drilling fluid during the well killing in step (4) is the temperature of the drilling fluid at the inlet of the drill pipe, and the temperature of the drilling fluid in the drill pipe can be calculated by the following relational formula:

$$A_p \rho_m v_p c_m \frac{\partial T_p}{\partial s} + m_p c_m \frac{\partial T_p}{\partial t} - 2\pi r_p \frac{U_p}{A_a}(T_a - T_p) = 0 \tag{21}$$

Where: $A_p$ denotes the cross sectional area inside the drill pipe, m$^2$; $\rho_m$ denotes the density of the drilling fluid in the drill pipe, kg/m$^3$; $v_p$ denotes the flow velocity of the drilling fluid in the drill pipe, m/s; $c_m$ denotes the specific heat capacity of the drilling fluid in the drill pipe, J/(kg·K); s denotes the distance from any point in the flow direction to the bottom hole, m; $m_p$ denotes the mass flow rate of the drilling fluid in the drill pipe, kg/s; t denotes time, s; $r_p$ denotes the drill pipe radius, m; $U_p$ denotes the total heat transfer coefficient in the drill pipe, W/(m$_2$·K); $A_a$ denotes the cross sectional area of the annulus, m$^2$; $T_a$ denotes the wellbore annulus temperature, K; and $T_p$ denotes the temperature of the drilling fluid in the drill pipe, K.

According to an embodiment of the invention, the mixed density of the drilling fluid in step (4) denotes the density of the mixture obtained by mixing up the base mud of the drilling fluid and seawater.

According to an embodiment of the invention, the density of the drilling fluid in the drill pipe refers to seawater density during the drilling and the mixed density of the drilling fluid during the well killing.

According to an embodiment of the invention, in step (4), the method can actively control the wellbore pressure within a safe range through intelligent active control before well kick, well leakage and other phenomena becoming prominent based on the real-time treatment results of the computer terminal for the signal fluctuations detected by the APWD, thereby improving the wellbore safety of the open-cycle drilling for marine NGH.

An active control device for wellbore pressure in the open-cycle drilling of marine natural gas hydrates, which comprises a drilling system, a drilling fluid injection system, and a data processing system;

The said drilling system comprises a rig, drill pipes, casing pipes, a cement sheath, and a bit, among which the said drill pipe is connected to the rig at one end and a bit at the other end, the said casing pipe is located on the outer side of the drill pipe, and the said cement sheath is located on the outer side of the casing pipe;

The said drilling fluid injection system comprises a drilling fluid base mud injection pump, a seawater injection pump, and an injection pipeline that connect to the drilling fluid mixer respectively. Among them, the said drilling fluid mixer is provided with a thermometer used to measure the temperature changes of the drilling fluid; at the outlet of the said drilling fluid base mud injection pump are arranged the first flowmeter and the first control valve sequentially which are used to measure the flow of the drilling fluid base mud and control the closure state of the drilling fluid base mud injection pump respectively; the said drilling fluid base mud injection pump connects to the drilling fluid base mud storage tank with its outlet; at the outlet of the seawater injection pump are located the second flowmeter and the second control valve which are used to measure the seawater injection flow rate and control the closure state of the seawater injection pump respectively; the said seawater injection pump connects to the seawater storage tank with its inlet; and the said drilling fluid mixer connects to the rig via the injection pipeline;

The said data processing system comprises an APWD, an optical cable, a photoelectric demodulator, a computer, and a signal actuator. Among them, the said computer connects to the photoelectric demodulator, the signal actuator, and the thermometer respectively, receives data from the photoelectric demodulator and the thermometer, and sends instructions to the signal actuator for injection of the drilling fluid base mud and the seawater; the said signal actuator connects to the drilling fluid base mud injection pump and the seawater injection pump respectively to send instructions issued by the computer for the injection of the drilling fluid base mud and the seawater; the said APWD is located in the drill collar that is 10 meters distant from the bit and used to measure the bottom hole temperature and pressure; and the said APWD connects to the photoelectric demodulator via the optical cable.

According to an embodiment of the invention, the said seawater storage tank is also provided with a suction pipe used to draw the seawater.

According to a preferred embodiment of the invention, the said drilling fluid mixer also has a temperature regulator inside which is used to raise or lower the temperature of the injected drilling fluid.

According to an embodiment of the invention, the said casing pipe and the said cement sheath shall be set up according to the standards of the field.

The working method of the said control device comprises the following steps:

During the drilling, the seawater enters the seawater storage tank via the suction pipe and then is injected into the drilling fluid mixer via the seawater injection pump and pumped into the drill pipe through the injection pipeline; after flowing through the bit to the bottom hole, it carries the cuttings and flows back to the seabed through the annulus between the drill pipe and the casing pipe. During the well killing, the drilling fluid base mud in the drilling fluid base mud storage tank and the sweater in the seawater storage tank are pumped into the drilling fluid mixer via the drilling fluid base mud injection pump and the seawater injection pump respectively for mixing and then injected into the drill pipe through the injection pipeline; after flowing through the bit to the bottom hole, they will flow back to the seabed through the annulus between the drill pipe and the casing pipe; the bottom-hole temperature and pressure data measured by the APWD in real time are transmitted to the photoelectric demodulator through the optical cable for conversion into optical signals and then transferred to the computer; the temperature data of the drilling fluid measured by the thermometer are transmitted to the computer; after receiving data from the photoelectric demodulator and thermometer, the computer will send instructions to the signal actuator for injection of the drilling fluid base mud and the seawater; the signal actuator then will transmit the computer-generated instructions for drilling fluid and seawater injection respectively to the drilling fluid base mud injection pump and the seawater injection pump.

Things left unmentioned in the invention shall be implemented according to the existing technologies of the field.

The beneficial effects of the invention are as follows:

1. The active control method for wellbore pressure in the open-cycle drilling of marine natural gas hydrates presented in the invention can monitor and intelligently and actively control the risks in the drilling of marine NGH. It can effectively reduce the safety risks in the drilling process of the marine NGH and thereby provide safety guarantee for the drilling operations by controlling and adjusting the key parameters, such as drilling fluid density, drilling fluid displacement, injection temperature of drilling fluid, and pump pressure in wellhead, actively.

2. The control method presented in the invention can reduce the requirements for the rig, improve the drilling efficiency and safety, and reduce the drilling costs effectively with the help of its simple calculations and scientific and reasonable procedures, thereby providing both theoretical and technical support for the safe and efficient drilling of marine NGH.

BRIEF DESCRIPTION OF THE FIGURES

FIG. Schematic diagram of the active control device for wellbore pressure in the open-cycle drilling of marine natural gas hydrates presented in the invention.

Where: 1. Seal level; 2. Seawater; 3. Submarine sub-bottom; 4. Hydrate reservoir; 5. Rig; 6. Drill pipe; 7. Casing pipe; 8. Cement sheath; 9. APWD; 10. Bit; 11. Optical cable; 12. photoelectric demodulator; 13. Computer; 14. Signal actuator; 15. Drilling fluid base mud injection pump; 16. Drilling fluid base mud storage tank; 17. First flowmeter; 18. Second control valve; 19. Seawater injection pump; 20. Seawater storage tank; 21. Suction pipe; 22. Second flowmeter; 23. Second control valve; 24. Drilling fluid mixer; 25. Thermometer; 26. Injection pipeline.

DETAILED EMBODIMENTS

The invention is further described in combination with the embodiments and the attached FIGURE as follows, but is not limited to that.

The APWD used in the embodiment is available for sale from the Halliburton Company.

Embodiment 1

An active control device for wellbore pressure in the open-cycle drilling of marine natural gas hydrates as shown in FIG., which comprises a drilling system, a drilling fluid injection system, and a data processing system;

The said drilling system comprises a rig 5, drill pipes 6, casing pipes 7, a cement sheath 8, and a bit 10, among which the said drill pipe 6 is connected to the rig 5 at one end and a bit 10 at the other end, the said casing pipe 7 is located on the outer side of the drill pipe 6, and the said cement sheath 8 is located on outer side of the casing pipe 7;

The said drilling fluid injection system comprises a drilling fluid base mud injection pump 15, a seawater injection pump 19, and an injection pipeline 26 that connect to the drilling fluid mixer 24 respectively. Among them, the said drilling fluid mixer 24 is provided with a thermometer 25; at the outlet of the said drilling fluid base mud injection pump 15 are arranged the first flowmeter 17 and the first control valve 18 sequentially; the said drilling fluid base mud injection pump 15 connects to the drilling fluid base mud storage tank 16 with its outlet; at the outlet of the seawater injection pump 19 are located the second flowmeter 22 and the second control valve 23; the said seawater injection pump 19 connects to the seawater storage tank 20 with its inlet; the said seawater storage tank 20 is provided with a suction pipe 21; and the said drilling fluid mixer 24 connects to the rig 5 via the injection pipeline 26;

The said data processing system comprises an APWD 9, an optical cable 11, a photoelectric demodulator 12, a computer 13, and a signal actuator 14. Among them, the said computer 13 connects to the photoelectric demodulator 12, the signal actuator 14, and the thermometer 25 respectively; the said signal actuator 14 connects to the drilling fluid base mud injection pump 15 and the seawater injection pump 19 respectively; the said APWD 9 is located in the drill collar that is 10 meters distant from the bit and connects to the photoelectric demodulator 12 via the optical cable 11.

The said drilling fluid mixer also has a temperature regulator inside it.

The working method of the said control device comprises the following steps:

During the drilling, the seawater enters the seawater storage tank 20 via the suction pipe 21 and then is injected into the drilling fluid mixer 24 via the seawater injection pump 19 and pumped into the drill pipe 6 through the injection pipeline 26; after flowing through the bit 10 to the bottom hole, it carries the cuttings and flows back to the seabed through the annulus between the drill pipe 6 and the casing pipe 7. During the well killing, the drilling fluid base mud in the drilling fluid base mud storage tank 16 and the sweater in the seawater storage tank 20 are pumped into the drilling fluid mixer 24 via the drilling fluid base mud injection pump 15 and the seawater injection pump 19 respectively for mixing and then injected into the drill pipe 6 through the injection pipeline 26; after flowing through the bit 10 to the bottom hole, they will flow back to the seabed through the annulus between the drill pipe 6 and the casing pipe 7; the bottom-hole temperature and pressure data measured by the APWD 9 in real time are transmitted to the photoelectric demodulator 12 through the optical cable 11 for conversion into optical signals and then transferred to the computer 13; the temperature data of the drilling fluid measured by the thermometer 25 are transmitted to the computer 13; after receiving data from the photoelectric demodulator 12 and the thermometer 25, the computer 13 will send instructions to the signal actuator 14 for injection of the drilling fluid base mud and the seawater; the signal actuator 14 then will transmit the computer-generated instructions for drilling fluid and seawater injection respectively to the drilling fluid base mud injection pump 15 and the seawater injection pump 19.

Embodiment 2

An active control method for wellbore pressure in the open-cycle drilling of marine natural gas hydrates based on the device as described in Embodiment 1, which comprises steps as follows:

(1) Optimized design of drilling parameters: design the drilling fluid displacement, pump pressure in wellhead, and injection temperature of drilling fluid during the drilling through calculations based on the data of the marine NGH reservoirs to be drilled to keep the bottom-hole temperature and pressure within a safe range to avoid well kick, well leakage, hydrate decomposition, and other down-hole problems.

To meet the requirements of rock breaking, cutting carrying, gas-cut prevention, and well leakage prevention, etc., the drilling fluid displacement during the drilling shall satisfy the following relational formula:

$$Q_{min}<Q<Q_{max} \tag{1}$$

Where: $Q_{min}$ denotes the theoretical minimum displacement, $m^3$/min; $Q_{max}$ denotes the theoretical maximum displacement, $m^3$/min; and Q denotes the drilling fluid displacement during the drilling.

The theoretical minimum displacement $Q_{min}$ is mainly affected by rock breaking, cutting carrying and gas-cut prevention etc., and it satisfies the following relational formula:

$$Q_{min}=\max(Q_p, Q_x, Q_q) \tag{2}$$

Where: $Q_p$ denotes the minimum rock-breaking displacement, $m^3$/min; $Q_x$ denotes the minimum cutting-carrying displacement, $m^3$/min; and $Q_q$ denotes the minimum displacement used to prevent shallow gas intrusion, $m^3$/min;

Among them, the minimum rock-breaking displacement $Q_p$ satisfies the following relational formula:

$$Q_p = k_f \pi d_{ne}^2 \left( \frac{S_u k^2 x^2}{16\lambda \rho_m R_0^2} \right)^{0.5} \tag{3}$$

Where: $k_f$ denotes the bit nozzle flow coefficient, which shall fall within 0.95-0.97; $d_{ne}$ denotes the equivalent diameter of the bit nozzle, m; $S_u$ denotes the shearing strength of soil, Pa; k denotes the half-width coefficient of jet flow; x denotes the impact flow path of jet flow, m; λ denotes the pressure drop coefficient of jet flow; $\rho_m$ denotes the density of the drilling fluid in the drill pipe, kg/$m^3$; and $R_0$ denotes the bit nozzle radius, m;

The minimum cutting-carrying displacement $Q_x$ satisfies the following relational formula:

$$Q_x = \frac{\pi}{4000}(d_w^2 - d_{po}^2)v_a \tag{4}$$

Where: $d_w$ denotes the inner diameter of the borehole, m; $d_{po}$ denotes the outer diameter of the drill pipe, m; and $v_a$ denotes the flow velocity of the drilling fluid in the annulus, m/s.

The minimum displacement required for prevention of shallow gas intrusion $Q_q$ satisfies the following relational formula:

$$Q_q = 0.592 d^{2.5} \left( \frac{P_r - P_{wh} - \rho_{sw} g h}{f \rho_{sw} L} \right) \tag{5}$$

Where: d denotes the cross section diameter, m; $P_r$ denotes the hydrate reservoir pressure, Pa; $P_{wh}$ denotes the hydrostatic pressure of the seawater, Pa; $\rho_{sw}$ denotes the seawater density, kg/$m^3$; g denotes the gravitational acceleration, m/$s^2$; h denotes the depth from the mud line to the bottom hole, m; f denotes the friction resistance coefficient of the annulus, which is zero-dimension; and L denotes the flow path of the drilling fluid, m.

The theoretical maximum displacement $Q_{max}$ is mainly affected by the equipment capacity and the formation security window, and it satisfies the following relational formula:

$$Q_{max}=\min(Q_s, Q_m) \tag{6}$$

Where: $Q_s$ denotes the maximum permissible displacement of the drilling equipment, $m^3$/min; and $Q_m$ denotes the maximum displacement allowed in the security window of the hydrate reservoir, $m^3$/min;

Among them, the maximum displacement allowed in the security window of the hydrate reservoir $Q_m$ is calculated as follows:

$$Q_m = 0.592 d^{2.5} \left( \frac{P_c - P_{wh} - \rho_{sw} g h}{f \rho_{sw} L} \right) \tag{7}$$

Where: $P_c$ denotes the minimum value of the bottom hole fracture pressure and the bottom hole leakage pressure, Pa; d denotes the cross section diameter, m; $P_{wh}$ denotes the hydrostatic pressure of seawater, Pa; $\rho_{sw}$ denotes the seawater density, kg/m$^3$; g denotes the gravitational acceleration, m/s$^2$; h denotes the depth from the mud line to the bottom hole, m; f denotes the friction resistance coefficient of the annulus, which is zero-dimension; and L denotes the flow path of the drilling fluid, m;

Among them, $P_c$ satisfies the following relational formula:

$$P_c=\min(P_p,P_L) \tag{8}$$

Where: $P_p$ denotes the bottom hole fracture pressure, Pa; and $P_L$ denotes the bottom hole leakage pressure, Pa.

The pump pressure in wellhead during the drilling is the sum of bit pressure drop, the drill pipe pressure loss, and the annulus pressure loss, as shown in the following formula:

$$P_b=\Delta P_z+\Delta P_p+\Delta P_a \tag{9}$$

Where: $P_b$ denotes the pump pressure in wellhead during the drilling, Pa; $\Delta P_z$ denotes the bit pressure drop, Pa; $\Delta P_p$ denotes the drill pipe pressure loss, Pa; $\Delta P_a$ denotes the annulus pressure loss, Pa.

The injection temperature of drilling fluid during the drilling refers to the temperature of the drilling fluid at the inlet of the drill pipe, and the temperature of the drilling fluid in the drill pipe can be calculated by the following relational formula:

$$A_p\rho_m v_p c_m\frac{\partial T_p}{\partial s}+m_p c_m\frac{\partial T_p}{\partial t}-2\pi r_p\frac{U_p}{A_a}(T_a-T_p)=0 \tag{10}$$

Where: $A_p$ denotes the cross sectional area inside the drill pipe, m$^2$; $\rho_m$ denotes the density of the drilling fluid in the drill pipe, kg/m$^3$; $v_p$ denotes the flow velocity of the drilling fluid in the drill pipe, m/s; $c_m$ denotes the specific heat capacity of the drilling fluid in the drill pipe, J/(kg·K); s denotes the distance from any point in the flow direction to the bottom hole, m; $m_p$ denotes the mass flow rate of the drilling fluid in the drill pipe, kg/s; t denotes time, s; $r_p$ denotes drill pipe radius, m; $U_p$ denotes the total heat transfer coefficient in the drill pipe, W/(m$_2$·K); $A_a$ denotes the cross sectional area of the annulus, m$^2$; $T_a$ denotes the wellbore annulus temperature, K; and $T_p$ denotes the temperature of the drilling fluid in the drill pipe, K;

Among them, the wellbore annulus temperature $T_a$ during the drilling satisfies the following relational formula:

$$A_p\rho_m v_a c_m\frac{\partial T_a}{\partial s}-m_a c_m\frac{\partial T_a}{\partial t}-2\pi r_a\frac{U_a}{A_a}(T_{en}-T_a)+2\pi r_p\frac{U_p}{A_a}(T_a-T_p)=0 \tag{11}$$

Where: $A_p$ denotes the cross sectional area inside the drill pipe, m$^2$; $\rho_m$ denotes the density of the drilling fluid in the drill pipe, kg/m$^3$; $v_a$ denotes the flow velocity of the drilling fluid in the annulus, m/s; $c_m$ denotes the specific heat capacity of the drilling fluid in the drill pipe, J/(kg·K); $T_a$ denotes the wellbore annulus temperature, K; s denotes the distance from any point in the flow direction to the bottom hole, m; $m_a$ denotes the mass flow rate of the drilling fluid in the annulus, kg/s; t denotes time, s; $r_a$ denotes the annulus radius, m; $U_a$ denotes the total heat transfer coefficient in the annulus, W/(m$_2$·K); $A_a$ denotes the cross sectional area of the annulus, m$_2$; $T_{en}$ denotes the temperature of the hydrate formation, K; $r_p$ denotes the drill pipe radius, m; $U_p$ denotes the total heat transfer coefficient in the drill pipe, W/(m$_2$·K); and $T_p$ denotes the temperature of the drilling fluid in the drill pipe, K.

To prevent the NGH in the peeling cuttings from decomposing in the annulus during the drilling, the wellbore annulus temperature $T_a$ needs to satisfy the following condition:

$$T_a<T_e \tag{12}$$

Where: $T_a$ denotes the wellbore annulus temperature, K; and $T_e$ denotes the equilibrium temperature of the NGH, K.

Among them, the equilibrium temperature of the NGH $T_e$ satisfies the following relational formula:

$$T_e=\frac{9459}{49.3185-\ln\left(\frac{P_a}{1.15}\right)} \tag{13}$$

Where: $P_a$ denotes the annulus pressure at a given well depth, Pa.

The wellbore annulus pressure at a given well depth $P_a$ during the drilling can be calculated as follows:

$$\frac{\partial P_a}{\partial s}=-\rho_{ca}v_a\frac{\partial v_a}{\partial s}-\rho_{ca}g\cos\theta-\frac{2f\rho_{ca}v_a^2}{D} \tag{14}$$

Where: s denotes the distance from any point in the flow direction to the bottom hole, m; $\rho_{ca}$ denotes the density of the drilling fluid in the annulus, kg/m$^3$; $v_a$ denotes the flow velocity of the drilling fluid in the annulus, m/s; g denotes the gravitational acceleration, m/s$^2$; θ denotes the hole drift angle, °; f denotes the friction resistance coefficient of the annulus, which is zero-dimension; and D denotes the equivalent diameter of the annulus, m.

(2) Open-cycle drilling: carry out open-cycle drilling according to the drilling parameters designed in step (1). During the drilling, the computer 13 will send an instruction to the signal actuator 14 for injection of the drilling fluid based on the designed drilling parameters; the signal actuator 14 then transfers the instruction to the seawater injection pump 19 to start the pump and open the second control valve 23; the pump then will inject the seawater stored in the seawater storage tank 20 into the drill pipe 6 via the drilling fluid mixer 24 and the injection pipeline 26; after flowing to the bottom hole through the bit 10, the seawater will carry cuttings and flow back to the seabed directly through the annulus between the drill pipe 6 and the casing pipe 7; and, at the same time, the seawater in the seawater storage tank 20 can be replenished through the suction pipe 21 in real time.

(3) Real-time monitoring of drilling: during the drilling, the bottom-hole temperature and pressure data measured in real time by the APWD 9 are transmitted to the photoelectric demodulator 12 via the optical cable 11 and then delivered to the computer 13 after being converted into electrical signals; the computer 13 can calibrate the wellbore annulus temperature and wellbore annulus pressure calculation models in real time by analyzing the bottom hole temperature and pressure changes to determine whether a hydrate decomposition has occurred in the annulus and then infer whether a shallow gas intrusion has occurred in the bottom hole, thereby laying a foundation for the intelligent active control of the wellbore pressure in the later stage;

The calculation model of the wellbore annulus temperature $T_a$ during the drilling is as shown in the following formula:

$$A_p\rho_m v_a c_m \frac{\partial T_a}{\partial s} - m_a c_m \frac{\partial T_a}{\partial t} - 2\pi r_a \frac{U_a}{A_a}(T_{en} - T_a) + 2\pi r_p \frac{U_p}{A_a}(T_a - T_p) = 0 \quad (15)$$

Where: $A_p$ denotes the cross sectional area inside the drill pipe, $m^2$; $\rho_m$ denotes the density of the drilling fluid in the drill pipe, $kg/m^3$; $v_a$ denotes the flow velocity of the drilling fluid in the annulus, m/s; $c_m$ denotes the specific heat capacity of the drilling fluid in the drill pipe, J/(kg·K); $T_a$ denotes the wellbore annulus temperature, K; s denotes the distance from any point in the flow direction to the bottom hole, m; $m_a$ denotes the mass flow rate of the drilling fluid in the annulus, kg/s; t denotes time, s; $r_a$ denotes the annulus radius, m; $U_a$ denotes the total heat transfer coefficient in the annulus, $W/(m_2 \cdot K)$; $A_a$ denotes the cross sectional area of the annulus, $m_2$; $T_{en}$ denotes the temperature of the hydrate formation, K; $r_p$ denotes the drill pipe radius, m; $U_p$ denotes the total heat transfer coefficient in the drill pipe, $W/(m_2 \cdot K)$; and $T_p$ denotes the temperature of the drilling fluid in the drill pipe, K.

The calibration procedures of the temperature model are as follows: calibrate the total heat transfer coefficient in the annulus ($U_a$) and the total heat transfer coefficient in the drill pipe ($U_p$) in the formula (15) by comparing the theoretical wellbore annulus temperature calculated by the formula (15) and the bottom hole temperature $T_{bh}$ measured by the APWD to make the wellbore annulus temperature $T_a$ calculated theoretically consistent with the bottom hole temperature $T_{bh}$ measured by the APWD, so that the temperature field distribution calculated by the temperature model of the wellbore annulus temperature $T_a$ can be more accurate; then, determine whether the hydrate in the wellbore annulus has decomposed by comparing the wellbore annulus temperature $T_a$ and the equilibrium temperature of the NGH $T_e$.

The calculation model of the wellbore annulus pressure at a certain well depth Pa during the drilling is as shown in the following formula:

$$\frac{\partial P_a}{\partial s} = -\rho_{ca} v_a \frac{\partial v_a}{\partial s} - \rho_{ca} g \cos\theta - \frac{2 f \rho_{ca} v_a^2}{D} \quad (16)$$

Where: s denotes the distance from any point in the flow direction to the bottom hole, m; $\rho_{ca}$ denotes the density of the drilling fluid in the annulus, $kg/m^3$; $v_a$ denotes the flow velocity of the drilling fluid in the annulus, m/s; g denotes the gravitational acceleration, $m/s^2$; θ denotes the hole drift angle, °; f denotes the friction resistance coefficient of the annulus, which is zero-dimension; and D denotes the equivalent diameter of the annulus, m.

The calibration procedures of the pressure model are as follows: calibrate the friction resistance coefficient of the annulus f in the formula (16) by comparing the bottom hole pressure $P_a$ theoretically calculated by the formula (16) and the bottom hole pressure $P_{bh}$ measured by the APWD to make the bottom hole temperature $P_a$ calculated theoretically consistent with the bottom hole pressure $P_{bh}$ measured by the APWD, so that the pressure distribution calculated by the pressure model of the wellbore annulus can be more accurate The judgment condition of whether hydrate decomposition has occurred in the bottom hole is:

$$T_{bh} < \frac{9459}{49.3185 - \ln\left(\frac{P_{bh}}{1.15}\right)} \quad (17)$$

Where: $T_{bh}$ denotes the bottom hole temperature measured by the APWD, K; and $P_{bh}$ denotes the bottom hole pressure measured by the APWD, Pa.

The judgment condition of whether shallow gas has intruded into the wellbore in the bottom hole is the bottom hole temperature measured by the APWD has increased by no less than 0.1° C. and the bottom hole pressure has decreased by no less than 0.1 MPa.

(4) Intelligent active control: in the case of hydrate decomposition in the annulus or shallow gas intrusion in the bottom hole based on the real-time treatment results of the computer terminal for the signal fluctuations detected by the APWD 9, the computer 13 will control and adjust the mixed density of the drilling fluid, the injection displacement of drilling fluid as well as the injection temperature of drilling fluid and the pump pressure in wellhead for well killing in real time automatically; the computer 13 then will send real-time instructions to the signal actuator 14 for mixing and injection of the drilling fluid based on the above well killing parameters; the signal actuator 14 then transmits the instructions to the drilling fluid base mud injection pump 15 and the seawater injection pump 19 to have the pumps start up and the first control valve 18 and the second control valve 23 open automatically; the pumps then will pump the drilling fluid base mud in the drilling fluid base mud storage tank 16 and the seawater in the seawater storage tank 20 into the drilling fluid mixer 24 respectively for mixing and injection into the drill pipe 6 via the injection pipeline 26; after reaching the seabed through the bit 10, the mixture of seawater and drilling fluid will carry the bottom-hole gas and flow back to the seabed through the annulus between the drill pipe 6 and the casing pipe 7. By doing this, intelligent active control of the wellbore pressure can be realized before well kick and well leakage, etc. becoming prominent, thereby guaranteeing the safety of the wellbore during the drilling. If no hydrate decomposition occurs in the annulus and no shallow gas invasion occurs in the bottom hole, continue with the drilling according to the drilling parameters set in step (1) and the procedures described in step (2) until drilling is completed. The said mixed density of the drilling fluid refers to the density of the liquid mixture obtained by mixing seawater with drilling fluid.

The mixed density of the drilling fluid during the well killing satisfies the following relational formula:

$$\frac{P_r - \rho_{sw} g h_{sw}}{gh} \le \rho_1 \le \frac{P_p - \rho_{sw} g h_{sw}}{gh} \quad (18)$$

Where: $P_r$ denotes the hydrate reservoir pressure, Pa; $\rho_{sw}$ denotes the seawater density, $kg/m^3$; g denotes the gravitational acceleration, $m/s^2$; $h_{sw}$ denotes the water depth at the seabed mud line, m; h denotes the depth from the mud line to the bottom hole, m; $\rho_1$ denotes the mixed density of the drilling fluid during the well killing, $kg/m^3$; and $P_p$ denotes the bottom hole fracture pressure, Pa.

The drilling fluid displacement for well killing is calculated as follows:

$$0.592d^{2.5}\left(\frac{P_r - P_{wh} - \rho_1 gh}{f\rho_1 L}\right) < Q_y < \min\left(Q_s, 0.592d^{2.5}\left(\frac{P_c - P_{wk} - \rho_1 gh}{f\rho_1 L}\right)\right) \quad (19)$$

Where: d denotes the cross section diameter, m; $P_r$ denotes the hydrate reservoir pressure, Pa; $P_{wh}$ denotes the hydrostatic pressure of seawater, Pa; $\rho_1$ denotes the mixed density of the drilling fluid during the well killing, kg/m$^3$; g denotes the gravitational acceleration, m/s$^2$; h denotes the depth from the mud line to the bottom hole, m; f denotes the friction resistance coefficient of the annulus, which is zero-dimension; L denotes the flow path of the drilling fluid, m; $Q_y$ denotes the drilling fluid displacement during the well killing, m$^3$/min; $Q_s$ denotes the maximum permissible displacement of the drilling equipment, m$^3$/min; and $P_c$ denotes the minimum value of the bottom-hole fracture pressure and the leakage pressure, Pa.

The pump pressure in wellhead during the well killing is the sum of the pressure difference between the inside and outside hydrostatic columns of the drill pipe and the cycling friction resistance of each section, and it satisfies the following relational formula:

$$P_{b2}=\Delta P_z+\Delta P_p+\Delta P_a+(\rho_{sw}-\rho_1)gh_{sw}\times 10^{-6} \quad (20)$$

Where: $P_{b2}$ denotes the pump pressure in wellhead during the well killing, Pa; $\Delta P_z$ denotes the bit pressure drop, Pa; $\Delta P_p$ denotes the drill pipe pressure loss, Pa; $\Delta P_a$ denotes the annulus pressure loss, Pa; $\rho_{sw}$ denotes the seawater density, kg/m$^3$; $\rho_1$ denotes the mixed density of the drilling fluid during the well killing, kg/m$^3$; g denotes the gravitational acceleration, m/s$^2$; and $h_{sw}$ denotes the water depth at the seabed mud line, m.

The injection temperature of drilling fluid during the well killing is the temperature of the drilling fluid at the inlet of the drill pipe, and the temperature of the drilling fluid in the drill pipe can be calculated by the following relational formula:

$$A_p\rho_m v_p c_m \frac{\partial T_p}{\partial s} + m_p c_m \frac{\partial T_p}{\partial t} - 2\pi r_p \frac{U_p}{A_a}(T_a - T_p) = 0 \quad (21)$$

Where: $A_p$ denotes the cross sectional area inside the drill pipe, m$^2$; $\rho_m$ denotes the density of the drilling fluid in the drill pipe, kg/m$^3$; $v_p$ denotes the flow velocity of the drilling fluid in the drill pipe, m/s; $c_m$ denotes the specific heat capacity of the drilling fluid in the drill pipe, J/(kg·K); s denotes the distance from any point in the flow direction to the bottom hole, m; $m_p$ denotes the mass flow rate of the drilling fluid in the drill pipe, kg/s; t denotes time, s; $r_p$ denotes the drill pipe radius, m; $U_p$ denotes the total heat transfer coefficient in the drill pipe, W/(m$_2$·K); $A_a$ denotes the cross sectional area of the annulus, m$^2$; $T_a$ denotes the wellbore annulus temperature, K; and $T_p$ denotes the temperature of the drilling fluid in the drill pipe, K.

Compared to the traditional passive wellbore pressure control method, which relies only on the drilling fluid density to achieve wellbore pressure control, the method can have the wellbore pressure controlled within the safe range actively by adjusting the density, displacement, temperature and pump pressure in wellhead of the drilling fluid comprehensively, thereby realizing intelligent and active control for the wellbore pressure in the open-cycle drilling of marine natural gas hydrates. Featuring simple operation, short time, and quick effect, the method can provide good protection for the gas hydrate reservoirs and avoid well kick, well leakage, and collapse.

What is claimed is:

1. An active control method for wellbore pressure in the open-cycle drilling of marine Natural Gas Hydrates (NGH), which comprises steps as follows:

(1) generating drilling parameters for an injection displacement of a drilling fluid, a pump pressure in a wellhead, and an injection temperature of the drilling fluid during a drilling based on data of the marine NGH reservoirs to be drilled;

(2) carrying out the open-cycle drilling according to the drilling parameters by injecting seawater into a drill pipe as the drilling fluid to carry cuttings from a bottom hole and discharging the seawater out of subsea wellhead through an annulus between the drill pipe and a casing pipe;

(3) monitoring temperature and pressure of the bottom-hole by an Annular Pressure While Drilling (APWD) in real time for correcting temperature and pressure of the annulus; determining occurrence of a hydrate decomposition in the annulus which further predicts occurrence of a shallow gas intrusion in the bottom hole, and collecting data for an intelligent active control of wellbore pressure;

(4) automatically controlling and adjusting mixed density of the drilling fluid, injection displacement of the drilling fluid, the injection temperature of the drilling fluid and the pump pressure in the wellhead during well killing when the occurrence of the hydrate decomposition in the annulus or the occurrence of the shallow gas intrusion in the bottom hole based on a real-time processing results of signal fluctuations, which are detected by the APWD, by a processor of the APWD; injecting the drilling fluid into the bottom hole via the drill pipe based on above well-killing parameters; if no hydrate decomposition occurs in the annulus and no shallow gas invasion occurs in the bottom hole, continuing with the drilling according to the drilling parameters set in step (1) until drilling is completed.

2. The active control method for wellbore pressure in the open-cycle drilling of marine natural gas hydrates according to claim 1, characterized in that the injection displacement of the drilling fluid during the drilling in step (1) satisfies the following relational formula:

$$Q_{min}<Q<Q_{max} \quad (1)$$

wherein $Q_{min}$ denotes a theoretical minimum displacement, m$^3$/min; $Q_{max}$ denotes a theoretical maximum displacement, m$^3$/min; and Q denotes the injection displacement of the drilling fluid during the drilling;

among them, the theoretical minimum displacement $Q_{min}$ satisfies the following relational formula:

$$Q_{min}=\max(Q_p, Q_x, Q_q) \quad (2)$$

wherein $Q_p$ denotes a minimum rock-breaking displacement, m$^3$/min; $Q_x$ denotes a minimum cutting-carrying displacement, m$^3$/min; and $Q_q$ denotes a minimum displacement used to prevent the shallow gas intrusion, m$^3$/min;

the minimum rock-breaking displacement $Q_p$ satisfies the following relational formula:

$$Q_p = k_f \pi d_{ne}^2 \left( \frac{S_u k^2 x^2}{16 \lambda \rho_m R_0^2} \right)^{0.5} \quad (3)$$

wherein $k_f$ denotes a bit nozzle flow coefficient, which shall fall within 0.95-0.97; $d_{ne}$ denotes an equivalent diameter of the bit nozzle, m; $S_u$ denotes shearing strength of soil, Pa; k denotes half-width coefficient of jet flow; x denotes an impact flow path of the jet flow, m; λ denotes a pressure drop coefficient of the jet flow; $\rho_m$ denotes a density of the drilling fluid in the drill pipe, kg/m$^3$; and $R_0$ denotes a bit nozzle radius, m;

the minimum cutting-carrying displacement $Q_x$ satisfies the following relational formula:

$$Q_x = \frac{\pi}{4000}(d_w^2 - d_{po}^2)v_a \quad (4)$$

wherein $d_w$ denotes an inner diameter of a borehole, m; $d_{po}$ denotes an outer diameter of the drill pipe, m; and $v_a$ denotes a flow velocity of the drilling fluid in the annulus, m/s;

the minimum displacement required for prevention of the shallow gas intrusion $Q_q$ satisfies the following relational formula:

$$Q_q = 0.592 d^{2.5} \left( \frac{P_r - P_{wh} - \rho_{sw} g h}{f \rho_{sw} L} \right) \quad (5)$$

wherein d denotes a cross section diameter, m; $P_r$ denotes a hydrate reservoir pressure, Pa; $P_{wh}$ denotes a hydrostatic pressure of the seawater, Pa; $\rho_{sw}$ denotes a seawater density, kg/m$^3$; g denotes a gravitational acceleration, m/s$^2$; h denotes ta depth from a mud line to the bottom hole, m; f denotes a friction resistance coefficient of the annulus, which is zero-dimension; and L denotes a flow path of the drilling fluid, m;

the theoretical maximum displacement $Q_{max}$ satisfies the following relational formula:

$$Q_{max} = \min(Q_s, Q_m) \quad (6)$$

wherein $Q_s$ denotes a maximum permissible displacement of a drilling equipment, m$^3$/min; $Q_m$ denotes a maximum displacement allowed in a security window of the hydrate reservoir, m$^3$/min;

the maximum displacement allowed in the security window of the hydrate reservoir $Q_m$ is calculated as follows:

$$Q_m = 0.592 d^{2.5} \left( \frac{P_c - P_{wh} - \rho_{sw} g h}{f \rho_{sw} L} \right) \quad (7)$$

wherein $P_c$ denotes a minimum value of a bottom hole fracture pressure and a bottom hole leakage pressure, Pa; d denotes a cross section diameter, m; $P_{wh}$ denotes a hydrostatic pressure of seawater, Pa; $\rho_{sw}$ denotes a seawater density, kg/m$^3$; g denotes a gravitational acceleration, m/s$^2$; h denotes depth from the mud line to the bottom hole, m; f denotes the friction resistance coefficient of the annulus, which is zero-dimension; and L denotes flow path of the drilling fluid, m;

among them, $P_c$ satisfies the following relational formula:

$$P_c = \min(P_p, P_L) \quad (8)$$

wherein $P_p$ denotes bottom hole fracture pressure, Pa; and $P_L$ denotes bottom hole leakage pressure, Pa.

3. The active control method for wellbore pressure in the open-cycle drilling of marine natural gas hydrates according to claim 1, characterized in that the pump pressure in the wellhead during the drilling in step (1) satisfies the following relational formula:

$$P_b = \Delta P_z + \Delta P_p + \Delta P_a \quad (9)$$

wherein $P_b$ denotes a pump pressure in the wellhead during the drilling, Pa; $\Delta P_z$ denotes a bit pressure drop, Pa; $\Delta P_p$ denotes a drill pipe pressure loss, Pa; and $\Delta P_a$ denotes a annulus pressure loss, Pa;

the injection temperature of the drilling fluid during the drilling refers to temperature of the drilling fluid at inlet of the drill pipe, and the temperature of the drilling fluid in the drill pipe can be calculated by the following relational formula:

$$A_p \rho_m v_p c_m \frac{\partial T_p}{\partial s} + m_p c_m \frac{\partial T_p}{\partial t} - 2\pi r_p \frac{U_p}{A_a}(T_a - T_p) = 0 \quad (10)$$

wherein $A_p$ denotes a cross sectional area inside the drill pipe, m$^2$; $\rho_m$ denotes a density of the drilling fluid in the drill pipe, kg/m$^3$; $v_p$ denotes a flow velocity of the drilling fluid in the drill pipe, m/s; $c_m$ denotes a specific heat capacity of the drilling fluid in the drill pipe, J/(kg·K); s denotes a distance from any point in the flow direction to the bottom hole, m; $m_p$ denotes a mass flow rate of the drilling fluid in the drill pipe, kg/s; t denotes time, s; $r_p$ denotes drill pipe radius, m; $U_p$ denotes total heat transfer coefficient in the drill pipe, W/(m$_2$·K); $A_a$ denotes a cross sectional area of the annulus, m$^2$; $T_a$ denotes the wellbore annulus temperature, K; and $T_p$ denotes the temperature of the drilling fluid in the drill pipe, K;

among them, the wellbore annulus temperature $T_a$ during the drilling satisfies the following relational formula:

$$A_p \rho_m v_a c_m \frac{\partial T_a}{\partial s} - m_a c_m \frac{\partial T_a}{\partial t} - 2\pi r_a \frac{U_a}{A_a}(T_{en} - T_a) + 2\pi r_p \frac{U_p}{A_a}(T_a - T_p) = 0 \quad (11)$$

wherein $A_p$ denotes cross sectional area inside the drill pipe, m$^2$; $\rho_m$ denotes density of the drilling fluid in the drill pipe, kg/m$^3$; $v_a$ denotes flow velocity of the drilling fluid in the annulus, m/s; $c_m$ denotes specific heat capacity of the drilling fluid in the drill pipe, J/(kg·K); $T_a$ denotes the wellbore annulus temperature, K; s denotes the distance from any point in the flow direction to the bottom hole, m; $m_a$ denotes the mass flow rate of the drilling fluid in the annulus, kg/s; t denotes time, s; $r_a$ denotes the annulus radius, m; $U_a$ denotes the total heat transfer coefficient in the annulus, W/(m$_2$·K); $A_a$ denotes the cross sectional area of the annulus, m$_2$; $T_{en}$ denotes the temperature of the hydrate formation, K; $r_p$ denotes the drill pipe radius, m; $U_p$ denotes the total heat transfer coefficient in the drill pipe, W/($m_2$·K); and $T_p$ denotes the temperature of the drilling fluid in the drill pipe, K.

4. The active control method for wellbore pressure in the open-cycle drilling of marine natural gas hydrates according to claim 3, characterized in that the wellbore annulus temperature $T_a$ during the drilling needs to satisfy the following condition:

$$T_a < T_e \tag{12}$$

wherein $T_a$ denotes the wellbore annulus temperature, K; and $T_e$ denotes equilibrium temperature of the NGH, K; among them, the equilibrium temperature of the NGH $T_e$ satisfies the following relational formula:

$$T_e = \frac{9459}{49.3185 - \ln\left(\frac{P_a}{1.15}\right)} \tag{13}$$

wherein $P_a$ denotes the annulus pressure at a given well depth, Pa;

the wellbore annulus pressure at a given well depth $P_a$ during the drilling can be calculated as follows:

$$\frac{\partial P_a}{\partial s} = -\rho_{ca} v_a \frac{\partial v_a}{\partial s} - \rho_{ca} g \cos\theta - \frac{2 f \rho_{ca} v_a^2}{D} \tag{14}$$

wherein s denotes the distance from any point in the flow direction to the bottom hole, m; $\rho_{ca}$ denotes the density of the drilling fluid in the annulus, kg/m$^3$; $v_a$ denotes the flow velocity of the drilling fluid in the annulus, m/s; g denotes the gravitational acceleration, m/s$^2$; θ denotes the hole drift angle, °; f denotes a friction resistance coefficient of the annulus, which is zero-dimension; and D denotes the equivalent diameter of the annulus, m.

5. The active control method for wellbore pressure in the open-cycle drilling of marine natural gas hydrates according to claim 1, characterized in that calculation model of the wellbore annulus temperature $T_a$ during the drilling in step (3) is as shown in the following formula:

$$A_p \rho_m v_a c_m \frac{\partial T_a}{\partial s} - m_a c_m \frac{\partial T_a}{\partial t} - 2\pi r_a \frac{U_a}{A_a}(T_{en} - T_a) + 2\pi r_p \frac{U_p}{A_a}(T_a - T_p) = 0 \tag{15}$$

wherein $A_p$ denotes a cross sectional area inside the drill pipe, m$^2$; $\rho_m$ denotes a density of the drilling fluid in the drill pipe, kg/m$^3$; $v_a$ denotes a flow velocity of the drilling fluid in the annulus, m/s; $c_m$ denotes a specific heat capacity of the drilling fluid in the drill pipe, J/(kg·K); $T_a$ denotes a wellbore annulus temperature, K; s denotes a distance from any point in the flow direction to the bottom hole, m; $m_a$ denotes a mass flow rate of the drilling fluid in the annulus, kg/s; t denotes time, s; $r_a$ denotes a annulus radius, m; $U_a$ denotes a total heat transfer coefficient in the annulus, W/($m_2$·K); $A_a$ denotes a cross sectional area of the annulus, m$^2$; $T_{en}$ denotes a temperature of the hydrate formation, K; $r_p$ denotes a drill pipe radius, m; $U_p$ denotes a total heat transfer coefficient in the drill pipe, W/($m_2$·K); and $T_p$ denotes the temperature of the drilling fluid in the drill pipe, K;

a calibration procedures of a temperature model are as follows: calibrate the total heat transfer coefficient in the annulus ($U_a$) and the total heat transfer coefficient in the drill pipe ($U_p$) in the formula (15) by comparing the theoretical wellbore annulus temperature calculated by the formula (15) and the bottom hole temperature $T_{bh}$ measured by the APWD to make the wellbore annulus temperature $T_a$ calculated theoretically consistent with the bottom hole temperature $T_{bh}$ measured by the APWD, so that the temperature field distribution calculated by the temperature model of the wellbore annulus temperature $T_a$ can be more accurate; then, determine whether the hydrate in the wellbore annulus has decomposed by comparing the wellbore annulus temperature $T_a$ and an equilibrium temperature of the NGH $T_e$;

the calculation model of the wellbore annulus pressure at a certain well depth $P_a$ during the drilling is as shown in the following formula:

$$\frac{\partial P_a}{\partial s} = -\rho_{ca} v_a \frac{\partial v_a}{\partial s} - \rho_{ca} g \cos\theta - \frac{2 f \rho_{ca} v_a^2}{D} \tag{16}$$

wherein s denotes the distance from any point in the flow direction to the bottom hole, m; $\rho_{ca}$ denotes density of the drilling fluid in the annulus, kg/m$^3$; $v_a$ denotes a flow velocity of the drilling fluid in the annulus, m/s; g denotes a gravitational acceleration, m/s$^2$; θ denotes a hole drift angle, °; f denotes a friction resistance coefficient of the annulus, which is zero-dimension; and D denotes an equivalent diameter of the annulus, m;

the calibration procedures of the pressure model are as follows: calibrate the friction resistance coefficient of the annulus f in the formula (16) by comparing the bottom hole pressure $P_a$ theoretically calculated by the formula (16) and the bottom hole pressure $P_{bh}$ measured by the APWD to make the bottom hole temperature $P_a$ calculated theoretically consistent with the bottom hole pressure $P_{bh}$ measured by the APWD, so that the pressure distribution calculated by the pressure model of the wellbore annulus can be more accurate.

6. The active control method for wellbore pressure in the open-cycle drilling of marine natural gas hydrates according to claim 1, characterized in that the judgment condition of whether hydrate decomposition has occurred in the bottom hole in step (3) is:

$$T_{bh} < \frac{9459}{49.3185 - \ln\left(\frac{P_{bh}}{1.15}\right)} \tag{17}$$

wherein $T_{bh}$ denotes bottom hole temperature measured by the APWD, K; and $P_{bh}$ denotes bottom hole pressure measured by the APWD, Pa;

a judgment condition of whether shallow gas has intruded into the wellbore in the bottom hole is the bottom hole temperature measured by the APWD has increased by no less than 0.1° C. and the bottom hole pressure has decreased by no less than 0.1 MPa.

7. The active control method for wellbore pressure in the open-cycle drilling of marine natural gas hydrates according to claim 1, characterized in that the mixed density of the drilling fluid during the well killing in step (4) satisfies the following relational formula:

$$\frac{P_r - \rho_{sw} g h_{sw}}{gh} \le \rho_1 \le \frac{P_p - \rho_{sw} g h_{sw}}{gh} \tag{18}$$

wherein $P_r$ denotes hydrate reservoir pressure, Pa; $\rho_{sw}$ denotes seawater density, kg/m$^3$; g denotes gravitational acceleration, m/s$^2$; $h_{sw}$ denotes water depth at a seabed mud line, m; h denotes depth from a mud line to the bottom hole, m; $\rho_1$ denotes the mixed density of the drilling fluid during the well killing, kg/m$^3$; and $P_p$ denotes bottom hole fracture pressure, Pa;

the drilling fluid displacement during the well killing is calculated as follows:

$$0.592 d^{2.5}\left(\frac{P_r - P_{wh} - \rho_1 g h}{f \rho_1 L}\right) < Q_y < \min\left(Q_s, 0.592 d^{2.5}\left(\frac{P_c - P_{wh} - \rho_1 g h}{f \rho_1 L}\right)\right) \tag{19}$$

wherein d denotes a cross section diameter, m; $P_r$ denotes a hydrate reservoir pressure, Pa; $P_{wh}$ denotes a hydrostatic pressure of seawater, Pa; $\rho_1$ denotes the mixed density of the drilling fluid during the well killing, kg/m$^3$; g denotes the gravitational acceleration, m/s$^2$; h denotes the depth from the mud line to the bottom hole, m; f denotes a friction resistance coefficient of the annulus, which is zero-dimension; L denotes flow path of the drilling fluid, m; $Q_y$ denotes the drilling fluid displacement during the well killing, m$^3$/min; $Q_s$ denotes maximum permissible displacement of the drilling equipment, m$^3$/min; and $P_c$ denotes minimum value of bottom-hole fracture pressure and a leakage pressure, Pa.

8. The active control method for wellbore pressure in the open-cycle drilling of marine natural gas hydrates according to claim 1, characterized in that the pump pressure in wellhead during the well killing in step (4) satisfies the following relational formula:

$$P_{b2} = \Delta P_z + \Delta P_p + \Delta P_a + (\rho_{sw} - \rho_1) g h_{sw} \times 10^{-6} \tag{20}$$

wherein $P_{b2}$ denotes the pump pressure in wellhead during the well killing, Pa; $\Delta P_z$ denotes a bit pressure drop, Pa; $\Delta P_p$ denotes a drill pipe pressure loss, Pa; $\Delta P_a$ denotes annulus pressure loss, Pa; $\rho_{sw}$ denotes seawater density, kg/m$^3$; $\rho_1$ denotes the mixed density of the drilling fluid during the well killing, kg/m$^3$; g denotes gravitational acceleration, m/s$^2$; and $h_{sw}$ denotes water depth at seabed mud line, m;

the injection temperature of the drilling fluid during the well killing is a temperature of the drilling fluid at inlet of the drill pipe, and the temperature of the drilling fluid in the drill pipe can be calculated by the following relational formula:

$$A_p \rho_m v_p c_m \frac{\partial T_p}{\partial s} + m_p c_m \frac{\partial T_p}{\partial t} - 2\pi r_p \frac{U_p}{A_a}(T_a - T_p) = 0 \tag{21}$$

wherein $A_p$ denotes cross sectional area inside the drill pipe, m$^2$; $\rho_m$ denotes the density of the drilling fluid in the drill pipe, kg/m$^3$; $v_p$ denotes flow velocity of the drilling fluid in the drill pipe, m/s; $c_m$ denotes specific heat capacity of the drilling fluid in the drill pipe, J/(kg·K); s denotes distance from any point in the flow direction to the bottom hole, m; $m_p$ denotes mass flow rate of the drilling fluid in the drill pipe, kg/s; t denotes time, s; $r_p$ denotes drill pipe radius, m; $U_p$ denotes total heat transfer coefficient in the drill pipe, W/(m$_2$·K); $A_a$ denotes cross sectional area of the annulus, m$^2$; $T_a$ denotes wellbore annulus temperature, K; and $T_p$ denotes the temperature of the drilling fluid in the drill pipe, K.

9. An active control device for wellbore pressure in an open-cycle drilling of marine natural gas hydrates, characterized in that it comprises a drilling system, a drilling fluid injection system, and a data processing system;

said drilling system comprises a rig, a drill pipe, a casing pipe, a cement sheath, and a bit, among which the drill pipe is connected to the rig at one end and said bit at the other end, the casing pipe is located on the outer side of the drill pipe, and the cement sheath is located on the outer side of the casing pipe;

said drilling fluid injection system comprises a drilling fluid base mud injection pump, a seawater injection pump, and an injection pipeline that connect to a drilling fluid mixer respectively; among them, the drilling fluid mixer is provided with a thermometer; at outlet of the drilling fluid base mud injection pump are arranged a first flowmeter and a first control valve sequentially; the drilling fluid base mud injection pump connects to a drilling fluid base mud storage tank with its outlet; at outlet of the seawater injection pump are located a second flowmeter and a second control valve; the seawater injection pump connects to the seawater storage tank with its inlet; and the drilling fluid mixer connects to the rig via the injection pipeline;

said data processing system comprises an Annular Pressure While Drilling (APWD), an optical cable, a photoelectric demodulator, a computer, and a signal actuator; among them, the computer connects to the photoelectric demodulator, the signal actuator, and the thermometer respectively; the signal actuator connects to the drilling fluid base mud injection pump and the seawater injection pump respectively; the APWD is located in a drill collar that is 10 meters distant from the bit; and the APWD connects to the photoelectric demodulator via the optical cable.

10. The active control device for wellbore pressure in the open-cycle drilling of marine natural gas hydrates according to claim 9, characterized in that the seawater storage tank is provided with a suction pipe, and the drilling fluid mixer has a temperature regulator inside.

* * * * *